US006418859B1

(12) United States Patent
Hentschel et al.

(10) Patent No.: US 6,418,859 B1
(45) Date of Patent: Jul. 16, 2002

(54) RUNNING GEAR FOR RAIL VEHICLES

(75) Inventors: Frank Hentschel, Berlin; Markus Koch, Schwabach; Andreas Daberkow, Stuttgart; Ulrich Hachmann, Pyrbaum; Wolfgang-Dieter Richter, Winkelhaid, all of (DE)

(73) Assignee: DaimlerChrysler AG (DE)

( * ) Notice: Subject to any disclaimer, the term of this patent is extended or adjusted under 35 U.S.C. 154(b) by 0 days.

(21) Appl. No.: 09/485,578

(22) PCT Filed: May 28, 1999

(86) PCT No.: PCT/EP99/03697

§ 371 (c)(1),
(2), (4) Date: Feb. 11, 2000

(87) PCT Pub. No.: WO99/65750

PCT Pub. Date: Dec. 23, 1999

(30) Foreign Application Priority Data

Jun. 13, 1998 (DE) ..... 198 26 448

(51) Int. Cl.[7] ..... B61F 5/00

(52) U.S. Cl. ..... 105/167; 105/34.1; 105/168; 105/157.1

(58) Field of Search ..... 105/34.1, 96.1, 105/96, 99, 167, 168; 180/131, 139, 79.2 R; 280/776

(56) References Cited

U.S. PATENT DOCUMENTS 4,100,990 A * 7/1978 Stedman ..... 180/419
4,299,172 A * 11/1981 Dawson ..... 104/244.1
4,542,699 A * 9/1985 Smith ..... 105/99
4,542,700 A * 9/1985 Smith ..... 105/166
4,941,409 A 7/1990 Richter et al. ..... 105/157.1
5,603,265 A * 2/1997 Jones ..... 105/167
5,730,064 A * 3/1998 Bishop ..... 105/168

FOREIGN PATENT DOCUMENTS

| | | | | |
|---|---|---|---|---|
| DE | 3546493 | | 8/1987 | |
| DE | 765791 | A1 * | 11/1994 | ..... B61F/5/38 |
| DE | 29613586 | | 12/1996 | |
| DE | 19620962 | | 11/1997 | |
| DE | 19620962 | A1 * | 11/1997 | |
| DE | 19620962 | A1 * | 11/1997 | ..... B61F/3/04 |
| EP | 0291491 | | 11/1988 | |
| EP | 0765791 | | 4/1997 | |

* cited by examiner

*Primary Examiner*—S. Joseph Morano
*Assistant Examiner*—Frantz F. Jules
(74) *Attorney, Agent, or Firm*—Webb Ziesenheim Logsdon Orkin & Hanson, P.C.

(57) ABSTRACT

A truck for a railway vehicle has a truck frame with four individual wheels, which are mounted so that they can rotate around horizontal axles, and whereby one wheel pair is driven. To be able to negotiate tight curves with minimal wear, maximum safety and low construction costs, and to be able to achieve higher speeds on straight segments of track, the driven wheel pair can be steered radially with respect to the curve around a common vertical axis as a function of a setpoint determined by a sensor system, while the non-driven individual wheels are combined into a self-steering individual wheel module so that they can each pivot around their own vertical axes, and can be coupled together so that they are synchronized by means of a steering device.

17 Claims, 4 Drawing Sheets

Fig. 1
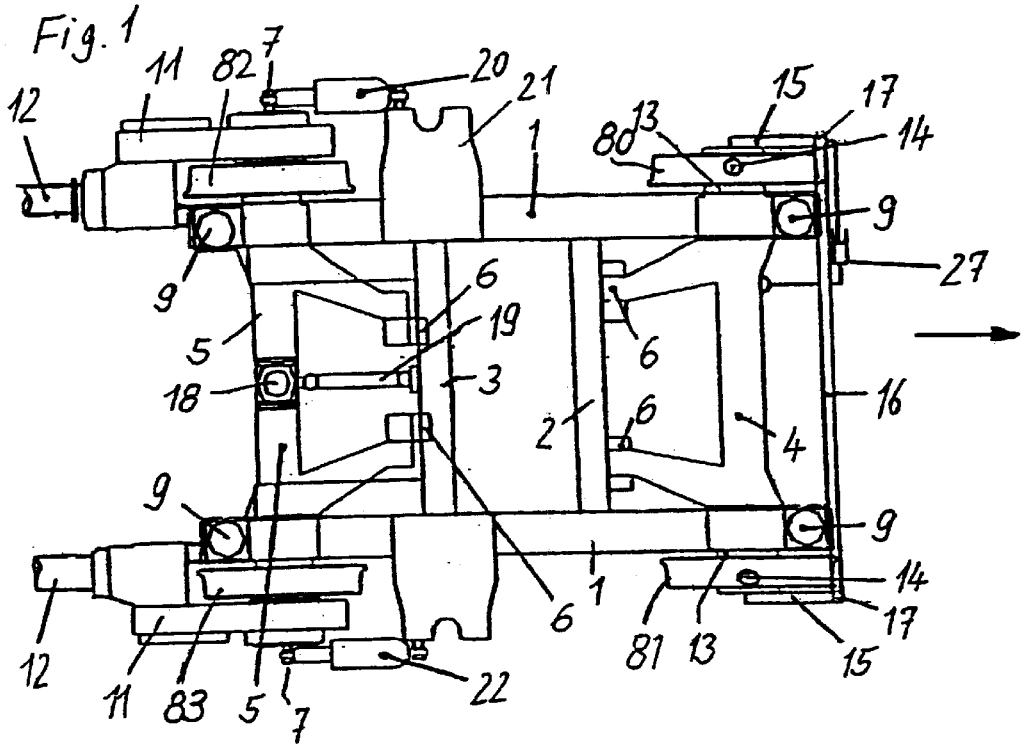
Fig 2
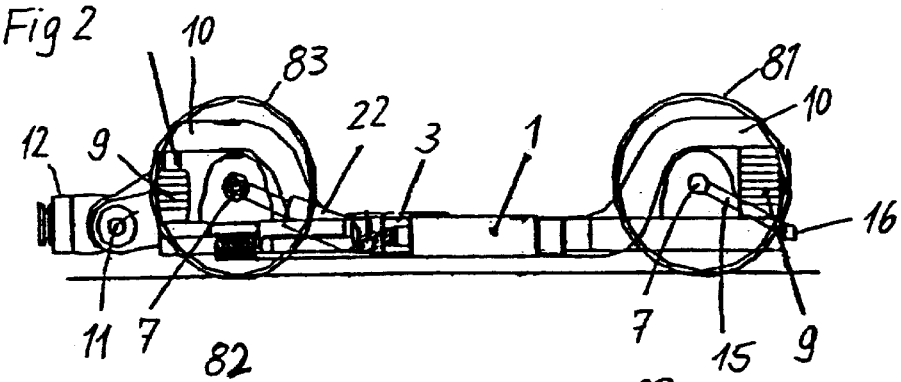
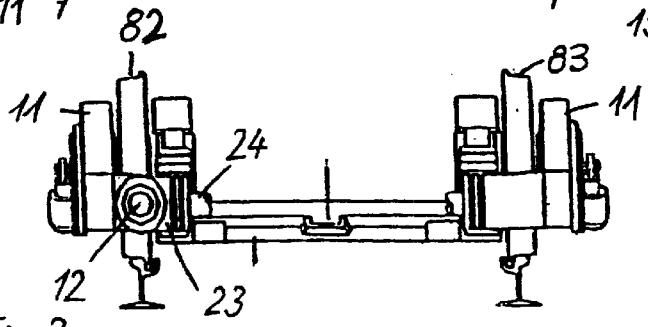
Fig.3

12
11
7
22
21
80
14
13
1
82
9
23
3
2
25
6
4
5
20
16
24
83
81

81
26
22
83
11
82
21
80
24
4
16
20

81
21
24
5
4
16
26
20
11
87

RUNNING GEAR FOR RAIL VEHICLES

BACKGROUND OF THE INVENTION

1. Field of the Invention

This invention relates to a truck and, more particulary, to a truck for a railway vehicle with a truck frame and four rotatable wheels where one pair of the wheels are driven.

2. Description of the Prior Art

A truck of this type disclosed in DE 38 08 593 that is used in particular for low-floor streetcars, has a truck frame and four individual wheels, i.e. 2 pairs of wheels, each of which is mounted so that it can rotate around horizontal axles on a hub carrier that is mounted on the truck frame so that it can pivot around a horizontal axis. The hub carriers are thereby fastened by flanges on the free ends of longitudinal beams of the truck frame, whereby next to each individual wheel there is a primary spring which is inserted between the hub carrier and the longitudinal beam located above it. The axles of the individual wheels are rigidly connected with the respective hub carriers. One wheel set on the same axle is thereby driven, for which purpose each individual wheel in question is coupled with a transmission. The two transmissions are jointly driven by a drive motor via a coupler mechanism.

SUMMARY OF THE INVENTION

The object of the invention is to create a truck which can travel with minimal wear, maximum safety and low construction costs in both tight curves and, at higher speeds, in straight portions of the track.

In one configuration of a truck as claimed by the invention, the non-driven wheels, which are generally the leading wheels in the direction of travel of the railway vehicle, can be adjusted automatically radially with respect to the rail and in particular to the curved rail, on account of their mounting that allows each of them to pivot around a vertical axis, and their ability to rotate freely on account of the wheel-rail geometry, whereby the steering device that is associated with this wheel pair forces the synchronized steering of both wheels. The non-driven wheels of the leading wheel set, which is constructed of a self-regulating single wheel module, as a result of their ability to pivot with respect to the joint hub carrier, can equalize the oscillations that occur at higher speeds, without transmitting the resulting movements in their full magnitude to the truck frame, which for its part supports the associated car body by means of primary springs. In addition, however, the other, driven wheel pair is mounted so that it can pivot around a vertical axis-which in this case is a common vertical axis-with respect to the truck frame. The pivoting of the driven wheel pair is thereby accomplished by means of an actively controlled actuator which, as a function of the radius of the current segment of track over which the train is traveling, determines the pivoting angle of this wheel pair, whereby its pivoting angle is opposite to the pivoting direction of the non-driven wheel pair. The pivoting occurs so that the wheel axes are oriented radially with respect to the track segment being traveled and the wheel planes are oriented tangentially to the track. The common hub carrier is thereby coupled to the truck frame so that it can pivot around a horizontal axis, and on the other hand is supported by means of primary springs against the underside of the truck frame. The individual wheels of the non-driven wheel pair, on the other hand, are preferably each mounted on individual hub carriers, which for their part are also mounted on a common hub carrier that is held on the truck frame so that it can pivot around a horizontal axis, so that the individual wheels can each be pivoted around a vertical axis. This hub carrier is also supported by means of primary springs against the underside of the truck frame, to provide the necessary ride comfort.

To achieve a defined ride of a truck as claimed by the invention, even if the operational control means to steer the driven wheel pair fail, a controllable reset device is associated with at least one wheel pair, and in this case preferably with the driven wheel pair. This reset device is optionally active if a control error is recorded. In that case, the operational steering control is deactivated, and instead the reset device is activated and automatically pivots the wheel pair or pairs, regardless of the radius of the track segment currently over which the vehicle is traveling, into a base position that is associated with a straight track. Preferably, in that case, a deceleration or braking process is also requested or automatically initiated to reduce the speed of the vehicle, if the speed is greater than a predetermined value and the radius of the curve is below a predetermined value. The allowable speed can thereby be controlled as a function of the radius of curvature of the track. But even in normal operation it is appropriate to lock the steerable hub carriers in the straight-ahead position by means of a blocking device which is preferably associated with the reset device if the radius of curvature assumes radius values that are above a predetermined threshold. The steering is thereby relieved of traction forces and the effects of abnormalities in the positions of the rails.

To minimize the steering action and thus maximize the ride comfort and to simultaneously achieve low wear between the wheels and the track, the actuator of the driven wheel set is appropriately set at the diametrically opposite angle as a function of the steering angle of at least one of the non-driven, forward individual wheels. Wear and noise generation are thereby reduced to minimum values, in particular when the vehicle is entering a curve from a straight track, or exiting a curve to a straight track, or is entering a transition curve from a straight track or exiting a transition curve into a straight track.

The steering device for the non-driven rail wheels is preferably equipped with a steering linkage which, together with the corresponding common hub carrier, forms a parallelogram suspension. The individual wheels which turn on their own thereby form a wheel set which is automatically oriented radially as a function of the forces that result from the wheel-rail geometry with regard to the track on which the vehicle is currently traveling. This advantageous effect is thereby also achieved in a track curve with a constant radius.

Between the steering linkage and the corresponding hub carriers or the truck frame, a damper or shock absorber can be inserted with a regulated suspension and damping action. The effects of uneven tracks and similar conditions are thereby not transmitted in their full magnitude into the control action of the non-driven wheels. The damping action can thereby be controlled as a function of the track curvature, and can assume very high values on the straight track. The above-mentioned blocking can also be thereby controlled. The shock absorber can accordingly be simultaneously constructed in the form of a blocking device, which suppresses adverse effects on the steering action not only in the straight track but also on a curve with a constant radius. It is thereby also appropriate to associate a displacement measurement device with at least one shock absorber and/or one actuator that corresponds to the driven wheels or even the independent reset device, if any, whereby the changes in the length of the displacement device can be used to measure the current steering angle of the individual wheels or wheel pairs to which it is coupled.

It is also possible, instead of a mechanical steering linkage, to provide a hydraulic coupling for the synchronous steering of the non-driven wheels, which forces the individual wheels to rotate by the same angle around their vertical axis.

In an articulated railway vehicle that has only one truck located in the longitudinal center of each car body, it is appropriate to arrange the trucks so that on vehicles that travel in only one direction, all of the non-driven wheel pairs are in front of the driven wheel pairs of the corresponding truck. On articulated railway vehicles that operate in two directions, on the other hand, the trucks are arranged so that the non-driven wheel pairs of the trucks in the end positions are toward the neighboring free ends of the vehicle with respect to the corresponding driven wheel pair. On the trucks located in between, the arrangement should be made, as far as possible, so that one driven wheel set is followed by another driven wheel set of the neighboring truck.

BRIEF DESCRIPTION OF THE DRAWINGS

The invention is explained in greater detail below with reference to the accompanying schematic diagrams of exemplary embodiments, in which:

FIG. 1 is an top plan view of a truck for a railway vehicle,

FIG. 2 is a side plan view of the truck,

FIG. 3 is a front plan view of a modified truck with regard to a transmission that has only one common drive shaft for a driven wheel set.

DESCRIPTION OF THE PREFERRED EMBODIMENTS

Figure 4:
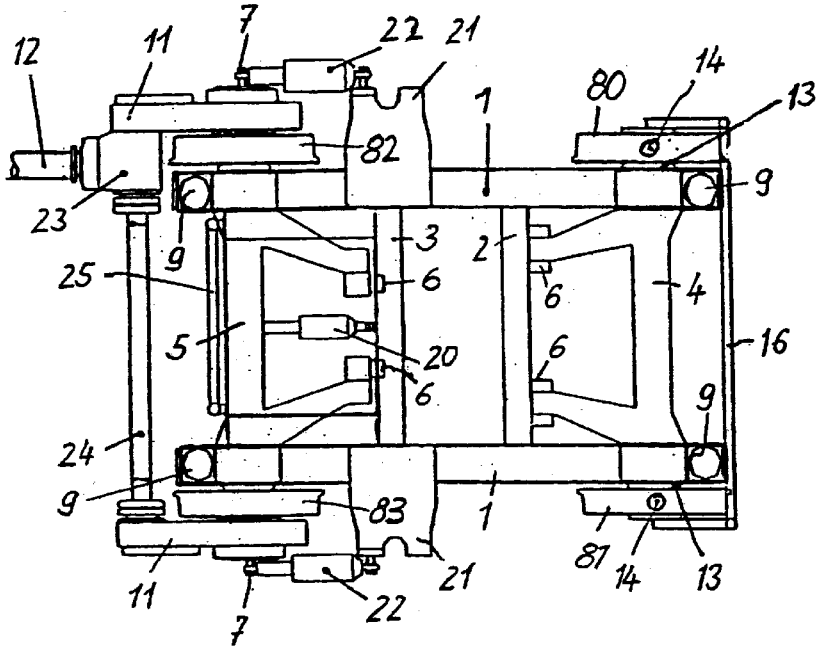
FIG. 4 is an top plan view of the truck illustrated in FIG. 3.

Referring to FIGS. 1–4, a truck, in particular a pivoting truck for low-floor streetcars, has a truck frame made of two longitudinal beams 1 that are oriented parallel to the longitudinal axis running in the direction of travel, and two cross beams 2 and 3 that are oriented at a right angle to the longitudinal beams in the longitudinal center portion. On each of the cross beams 2, 3 there is a two armed hub carrier 4 and 5 respectively, mounted so that they can pivot around a horizontal axis in low-wear elastomer bushings 6 by means of the arms. The bridge-shaped hub carriers 4, 5 are attached by means of flanges to the ends of the longitudinal beams 1, which are bent upward at substantially a right angle. The longitudinal beams 1, in the vicinity of the cross beams 2, 3, have a middle section that is lower than the horizontal axes of rail wheels 80–83. The hub carriers 4, 5 are thereby elastically supported by means of primary spring elements 9 against the underside of the free ends 10 of the longitudinal beams 1. Two rail wheels 80 and 81 are thereby rotationally mounted laterally outboard next to the free ends of the longitudinal beams 1 on the hub carrier 4 and two additional rail wheels 82 and 83 on the symmetrically opposite hub carrier 5 so that they can rotate around the horizontal axles 7. The rail wheels 80 and 81 on the leading hub carrier 4 are thereby not driven, while the wheel pair 82 and 83 on the associated hub carrier 5 are coupled by means of a transmission system 11 via drive shafts 12 with separate drive motors (not shown). The rail wheels 82 and 83 are thereby mounted on the hub carrier 5 on axles 7 that are non-detachably connected to the hub carrier 5. On the other hand, the axles 7 of the non-driven wheel pair 80 and 81 are fastened to individual hub carriers 13 which, for their part, are mounted on the corresponding hub carrier 4 so that they can each pivot around a vertical axis 14. To guarantee a steering of the non-driven individual wheels 80 and 81 around their vertical axes 14 that results from the forces of the wheel-rail geometry, the corresponding axles 7 are pivotably connected by means of pivots 17 via steering arms 15 that are oriented parallel to the longitudinal beams and are fastened on one end to the corresponding axles 7 with a common steering linkage 16 that runs at right angles to the longitudinal beams 1. The steering device 15, 16, 17 thereby forms, together with the corresponding hub carrier 4, the individual hub carriers 13 and the steering linkage 16 between the hub carrier 4 and the individual hub carriers 13 a parallelogram suspension. The non-driven rail wheels 80 and 81 thus represent, with regard to the steering, self-adjusting individual wheel modules which are steered automatically by the forces of the wheel-rail geometry as a function of the curve, so that the wheel planes are always tangential to the segment of track over which the vehicle is traveling.

The hub carrier 5 of the other, driven wheel pair 82 and 83 is capable of pivoting around a common, longitudinally central vertical axis around a pivot system 18 that is located there in a horizontal plane parallel to a plane that contains the cross members 2, 3. For this purpose, the hub carrier 5 is coupled in the longitudinal center by means of a coupling link 19 with the neighboring cross beam 3, and on the other end is connected so that it can pivot in the vicinity of the pivot system 18 with the crosspiece of the hub carrier 5. To make possible a pivoting movement of the hub carrier 5, its arms directed from the crosspiece to the cross beam 3 are held pivotably by means of the bearings 6 located there along the cross beam 3 in sideways. The pivot system 18 can thereby have, for example, a pivot that is connected with the truck frame 1, which pivot is fastened between side brackets that are fastened to the corresponding hub carrier 5.

To achieve an active steering of the driven wheel pair 82 and 83 there is a controllable actuator element 20 which is coupled to a support surface 21, which for its part is non-detachably connected with the longitudinal beam 1 and is intended for the support of a primary spring. The actuator element 20 is thereby coupled on the other end with the axle 7 of one of the driven wheels 82 and 83. The length of the actuator element 20 can change, and it can be equipped as an actuator with hydraulic, pneumatic or electrical spindle drive. The change in the length of this actuator element 20 is thereby controlled as a function of the radius of curvature of the segment of track over which the vehicle is currently traveling. For this purpose it is appropriate to associate an angle-of-rotation sensor with at least one individual hub carrier 13 of the non-driven wheel set 80 and 81 as a function of which the actuator element 20 is controlled. When there is a change in the length of the actuator element, the hub carrier 5 with the driven wheels 82 and 83 is pivoted around the pivot arrangement 18 so that the axles of this wheel pair are also radial with respect to the track segment, when the vehicle is traveling either over straight track or around curves. The pivoting direction of the driven rail wheels 82 and 83 is thereby opposite to the pivoting direction of the non-driven individual wheels 80 and 81 to achieve a radial orientation of both wheel sets to the segment of track over which the vehicle is currently traveling.

Also associated with the driven wheel pair 82 and 83 is a controllable reset device 22, which is coupled like the actuator element 20 to a bearing surface 21 for a primary spring element associated with the longitudinal beam 1, and is connected on the other end with the axle 7 of the wheel rail, the one not associated with the controllable actuator element 20. It is thereby possible to also orient this reset device 22 parallel to the actuator element 20, or to integrate the two elements 21, 22 into a unit, and to associate it with both axles 7, if necessary. The length of the reset device 22 can also be changed, so that in normal steering operation, by means of the actuator 20, it tracks the steering movements of the corresponding axle 7 without any opposing force. However, if the actuator 20 of the corresponding control means fail or are deliberately deactivated, the reset device is then automatically controlled so that, when the actuator 20 has no effect on the steering, an integrated energy storage mechanism automatically pivots the hub carrier 5 into a base position which is associated with travel over a straight track. In this case, it is irrelevant whether the truck is on a straight track or on a Curved segment of track. For this purpose, it is appropriate to also associate with the reset device a blocking device which, under these operating conditions, locks the truck in the base position. This device can then only be unlocked if the steering operation via the actuator element 20 has returned to normal. Therefore it may be appropriate to also associate such a reset device with the non-driven wheel pair 80 and 81 to guarantee stable running conditions.

On the truck illustrated in FIG. 4, associated with the driven wheel pair 82 and 83 is a transmission system, in which the two transmissions associated with the individual wheels 82 and 83 are coupled by means of a common limited-slip differential transmission 23 and a transverse shaft 24 with a single drive shaft 12 for only one drive motor. On this truck, the actuator 20 that is used as the actuator element for the active steering of the driven wheel set is placed in the longitudinal center of the truck in the place of the coupling link 19 illustrated in FIG. 1, while the axles of the two driven wheels 82 and 83 are each associated with a reset device 22, the other end of which is pivotably coupled with the respective bearing support 21. The associated hub carrier 5 is thereby no longer held by means of a pivot system 18 but by means of a suspension arm 25 to the truck frame to prevent transverse displacement. The reset devices 22 are also equipped with integrated locking devices, which are locked, i.e. they do not permit any change in the length of the reset elements as long as, during normal operation of the steering control, no control signal requiring a change of the steering angle has been sent to the actuator 20. Both locking devices in the reset elements 22 remain blocked if from at least one steering sensor associated with one of the non-driven rail wheels 80 and 81 no signal is generated that requires a change in the steering angle. However, if a steering signal is generated which requires a change in the steering angle, then not only is a change in length on the actuator 20 ordered for the steering angle direction, but also one of the locking devices is released and then the other is released. The coupling point between the wheel axle 7 and the locked locking device then forms a pivot around which the associated hub carrier 5 is pivoted to change the length of the actuator 20. Here, too, the arms of the hub carrier 5, which are movably guided in the cross beam 3, with their bearings 6 act as horizontal pivoting axes for the hub carriers and as torque bearings. The construction and function of the non-driven wheel set with the control device is in this case unchanged with respect to the exemplary embodiment illustrated in FIG. 1.

For example, to at least significantly reduce the level of unpleasant vibrations caused by abnormalities in the track on the self-adjusting individual wheel module, a shock absorber 27 as illustrated in FIG. 1 is connected on one end on the steering linkage 15, 16 and on the other end with the hub carrier or, if necessary, also with the truck frame, which shock absorber 27 has a controllable suspension and damping action. The suspension and damping action can thereby be controlled as a function of the radius of curvature of the track over which the vehicle is traveling and also, if necessary, as a function of the speed of travel. It is thereby appropriate to increase the damping action in the event of large abnormalities, so that there is a brief locking of the shock absorber 27 tuned to the abnormality. As a result, incorrect steering movements are prevented, and the resulting vibrations are absorbed by the elastic mounting of the hub carrier 4 in the primary suspension 9 and the elastic bearings 6. A displacement measurement device can also be associated with the shock absorber 27, and during normal operation of the truck, the displacement measurement device can measure the steering movement of this self-adjusting wheel pair 80 and 81 that results from the wheel-rail geometry and thereby generate a signal that can be evaluated to determine the current steering angle. If the shock absorber 27 is not constructed so that it is self-locking, it is also possible to lock the steering linkage with respect to the hub carrier by means of its own controllable locking device if necessary.

Referring to figures if trucks on a car body 26 are associated with the individual car bodies 26 of a multi-element railway vehicle, then they are oriented with reference to the location and orientation of the driven and non-driven wheel pairs as a function of the direction of travel of the vehicle.

Figure 5:
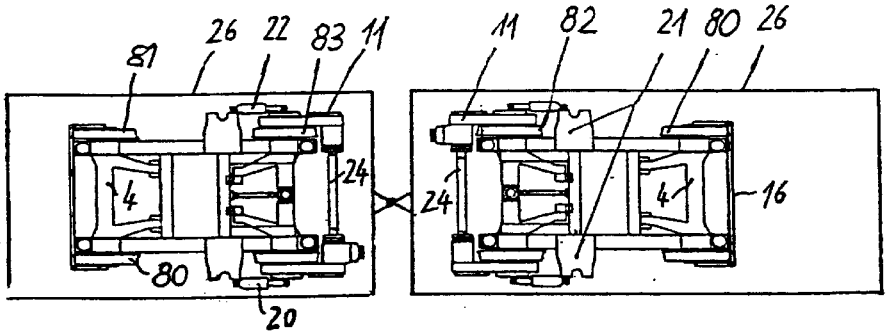
FIG. 5 is a top plan view of an arrangement of trucks on a two-element railway vehicle that can be operated in two directions of travel.

FIG. 5 illustrates a two-element railway vehicle in which the non-driven wheel pair 80 and 81 are located closer to the neighboring free ends of the respective car bodies 26 than the wheel pair 82 and 83 that are driven by the transmissions 11. In this arrangement, the railway vehicle is suitable for bidirectional operation.

Figure 6:
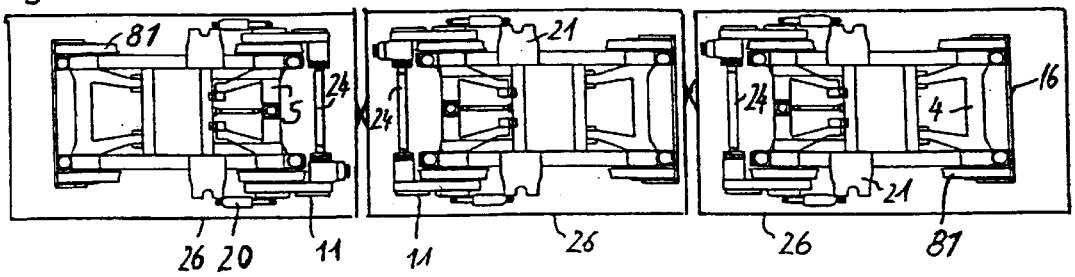
FIG. 6 is a top plan view of an arrangement of trucks on a three-element railway vehicle that can be operated in two directions of travel.

As shown in FIG. 6, between the arrangement illustrated in FIG. 5, a third car body 26 has been inserted, on which the associated truck has the same directional orientation of the wheel sets as one of the neighboring tucks. This three-element railway vehicle is also suitable for bidirectional operation, because in each direction of travel the first wheel pair of the farthest forward car body is a leading, non-driven wheel pair self-steering wheel pair 80 and 81 initiates the steering process when the vehicle enters a curve, while the vehicle is traveling around the curve proper, and also when the vehicle returns to a straight track.

Figure 7:
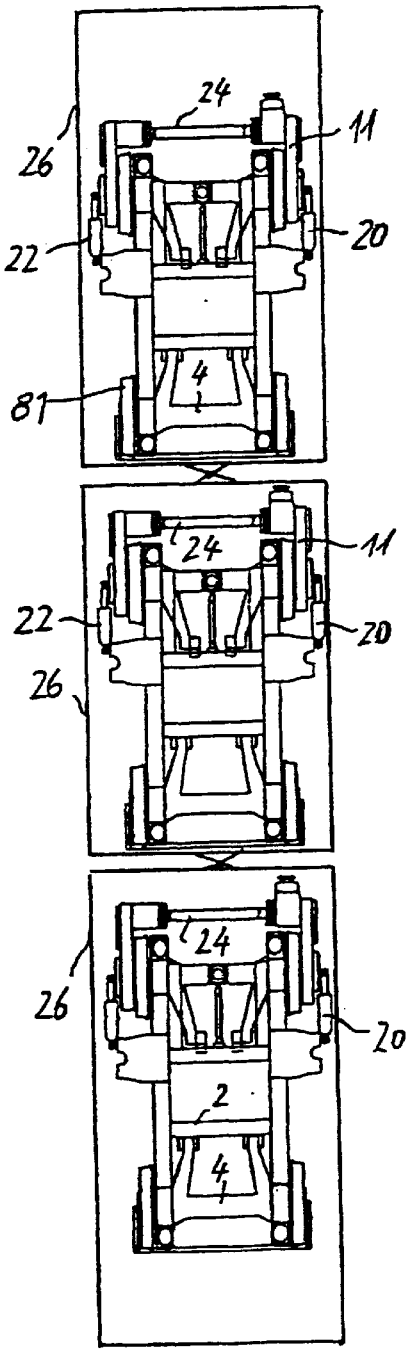
FIG. 7 is a top plan view of the arrangement of trucks on a three-element railway vehicle that can be operated in only one direction of travel.

In the arrangement of the trucks illustrated in FIG. 7, all the non-driven wheel pairs 8 in one direction of travel are located ahead of the trailing driven wheel pairs. This arrangement is adapted for unidirectional operation, and the vehicle equipped in this manner can only be driven in reverse at significantly reduced speed.

Figure 8:
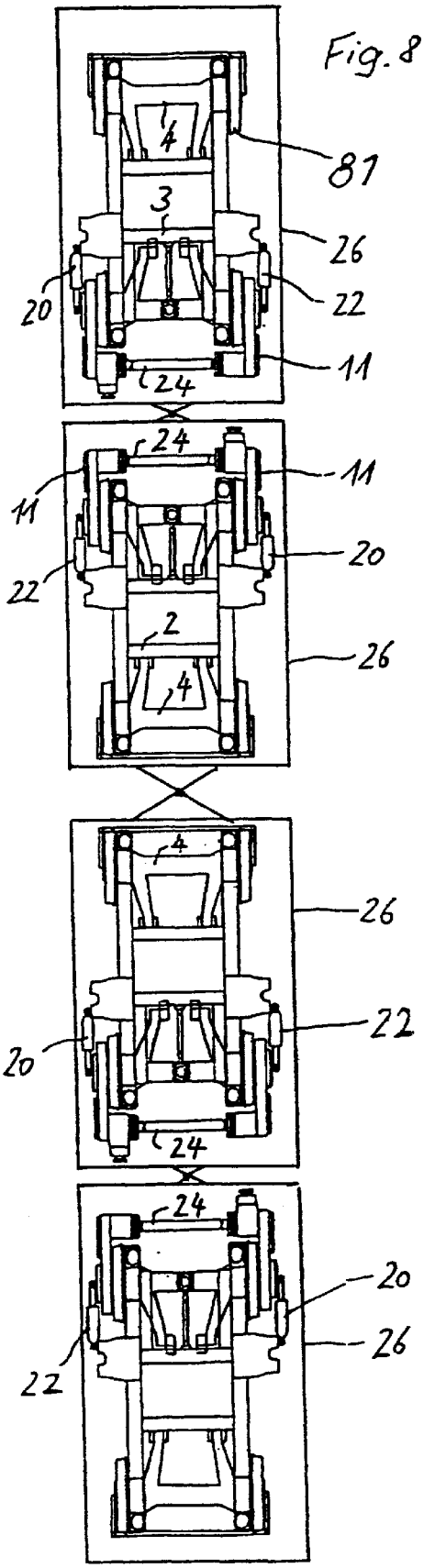
FIG. 8 is a top plan view of an arrangement of trucks on a four-element railway vehicle that can be operated in two directions of travel.
Figure 9:
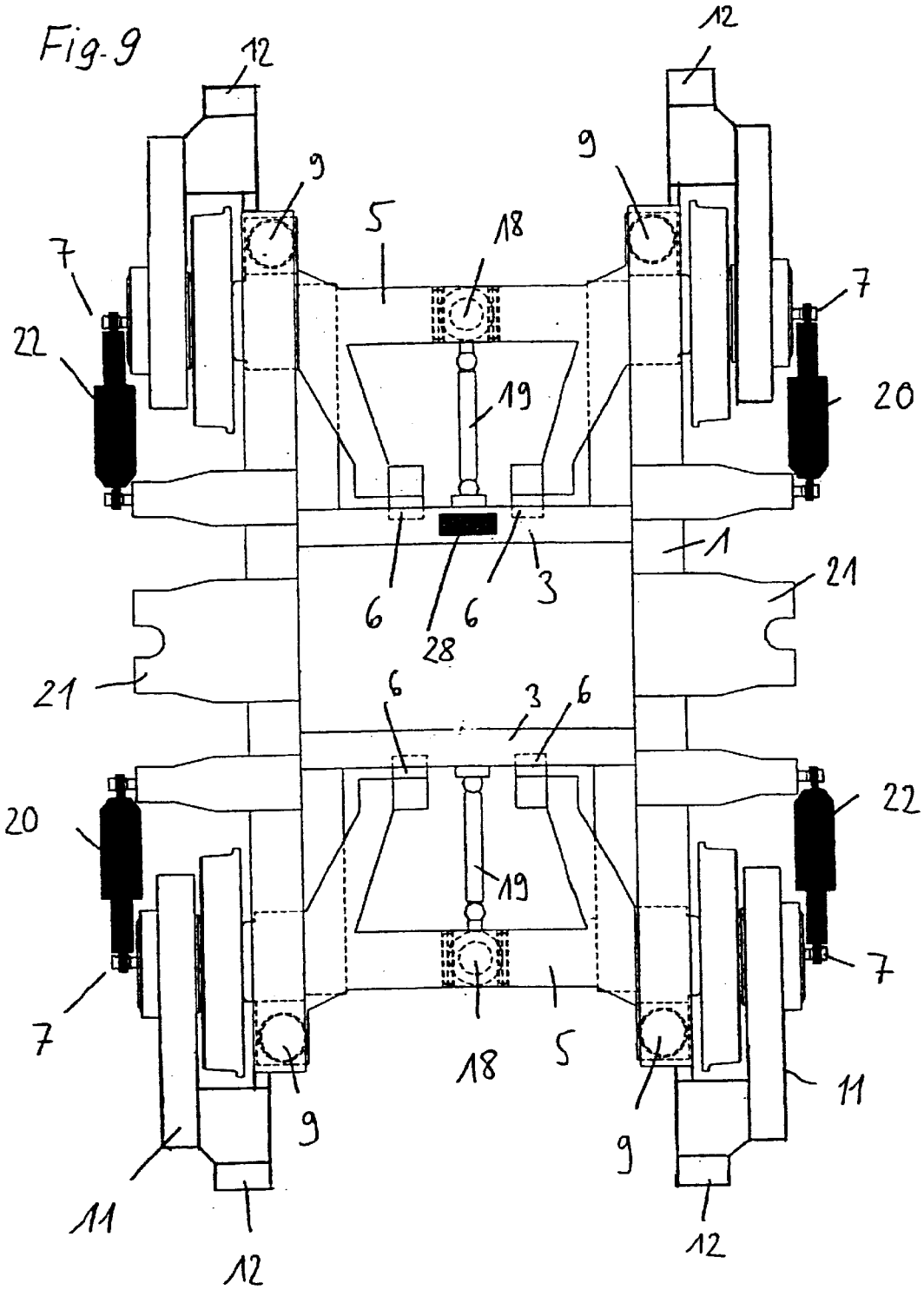
FIG. 9 is a top plan view of a truck with four individual wheels driven in pairs.

In the arrangement illustrated in FIG. 8, two units as illustrated in FIG. 5 are coupled to each other, thereby forming a four-element railway vehicle that is equipped for bidirectional operation, with a non-driven wheel pair 80 and 81 on the leading train ends in the direction of travel. Here again, the self-steering ability of the first set of non-driven wheels 80 and 81 that is ahead of the other wheel sets makes it possible for the vehicle to travel at high speed on straight track and on curved track, with little wear and a high degree of comfort.

What is claimed is:

1. A truck for a railway vehicle with a truck frame and four individual wheels which are mounted so that they can rotate around horizontal axles, whereby one wheel pair is driven, wherein the driven wheel pair is mounted so that the driven wheel pair can pivot around a common vertical axis and the non-driven individual wheels are each mounted so that they can pivot around their own vertical axes, and that the non-driven individual wheels are coupled by means of a steering device for a common synchronized pivoting around their vertical axes.

2. The truck as claimed in claim 1, wherein the driven wheel pair is mounted on a driven wheel common hub carrier and is coupled with an actuator which is controlled as a function of the radius of curvature of a track over which the vehicle is currently traveling, and pivots the driven wheel common hub carrier as a function of the radius, whereby the hub carrier is hinged on one end around the horizontal axis on a truck frame and is supported on the other end by means of primary springs against the underside of the truck frame.

3. Truck as claimed in claim 2, wherein coupled with at least one wheel pair is a controllable reset device which, regardless of the radius of the segment of track on which the vehicle is currently traveling, optionally automatically pivots the associated wheel set into a base position that corresponds to a straight track.

4. The truck as claimed in claim 2, wherein the actuator of the driven wheel set is controlled as a function of the steering angle of at least one of the non-driven individual wheels and is in the opposite angular direction.

5. A truck for a railway vehicle with a truck frame and four individual wheels which are mounted so that they can rotate around horizontal axles, whereby one wheel pair is driven, wherein the driven wheel pair is mounted so that the driven wheel pair can pivot around a common vertical axis and the non-driven individual wheels are each mounted so that they can pivot around their own vertical axes, and that the non-driven individual wheels are coupled by means of a steering device for a common synchronized pivoting around their vertical axes, wherein coupled with at least one wheel pair is a controllable reset device which, regardless of the radius of the segment of track on which the vehicle is currently traveling, optionally automatically pivots the associated wheel set into a base position that corresponds to a straight track.

6. The truck as claimed in claim 5, wherein the individual wheels of the non-driven wheel pair are mounted on a non-driven wheel common hub carrier so that they can rotate freely on individual hub carriers around horizontal axles, that the individual hub carriers are individually mounted so that they can pivot on the non-driven wheel common hub carrier that is held on the truck frame so that the non-driven wheel common hub carrier can pivot around a vertical axis, on the end of which non-driven wheel common hub carrier the truck frame is supported by means of primary springs.

7. The truck as claimed in claim 6, wherein the steering device has a steering linkage which, together with the Corresponding common hub carrier, forms a parallelogram suspension.

8. The truck as claimed in claim 6, wherein the individual hub carriers of the non-driven wheel pair are coupled by means of a hydraulic coupling, which controls a rotation of the individual hub carriers by the same angle around their vertical axis.

9. A truck for a railway vehicle with a truck frame and four individual wheels which are mounted so that they can rotate around horizontal axles, whereby one wheel pair is driven, wherein the driven wheel pair is mounted so that the driven wheel pair can pivot around a common vertical axis and the non-driven individual wheels are each mounted so that they can pivot around their own vertical axes, and that the non-driven individual wheels are coupled by means of a steering device for a common synchronized pivoting around their vertical axes, wherein the individual wheels of the non-driven wheel pair are mounted on a non-driven wheel common hub carrier so that they can rotate freely on individual hub carriers around horizontal axles, that the individual hub carriers are individually mounted so that they can pivot on the non-driven wheel common hub carrier that is held on the truck frame so that the non-driven wheel common hub carrier can pivot around a vertical axis, on the end of which non-driven wheel common hub carrier the truck frame is supported by means of primary springs.

10. The truck as claimed in claim 9, wherein the actuator of the driven wheel set is controlled as a function of the steering angle of at least one of the non-driven individual wheels and is in the opposite angular direction.

11. The truck as claimed in claim 10, wherein the steering device has a steering linkage which, together with the corresponding common hub carrier, forms a parallelogram suspension.

12. The truck as claimed in claim 11, wherein at least one shock absorber with controlled suspension and damping action is inserted between the steering linkage and the corresponding hub carrier or the truck frame.

13. The truck as claimed in claim 12, wherein associated with at least one shock absorber and/or one actuator and/or one reset device is a distance measuring device, the changes in length of which are a measurement of the respective current steering angle of the individual wheels or wheel pairs to which the distance measuring device is coupled.

14. The truck as claimed in claim 13, wherein the shock absorber can be locked in position.

15. The truck as claimed in claim 14, wherein the locking of the shock absorber is controlled as a function of the speed of travel and/or as a function of the curvature of the track.

16. The truck as claimed in claim 15, wherein the individual hub carriers of the non-driven wheel pair are coupled by means of a hydraulic coupling, which controls a rotation of the individual hub carriers by the same angle around their vertical axis.

17. The truck as claimed in claim 12, wherein the shock absorber can be locked in position.

* * * * *

UNITED STATES PATENT AND TRADEMARK OFFICE

CERTIFICATE OF CORRECTION

PATENT NO. : 6,418,859 B1
DATED : July 16, 2002
INVENTOR(S) : Frank Hentschel et al.

It is certified that error appears in the above-identified patent and that said Letters Patent is hereby corrected as shown below:

Title page,
Item [73], Assignee, "DaimlerChrysler AG (DE)" should read -- Daimler-Chrysler Rail Systems GmbH (DE) --

Column 5,
Line 30, "Curved" should read -- curved --.

Column 6,
Line 39, "figures" should read -- FIG. 5, --.
Line 54, "tucks" should read -- trucks --.
Line 58, after "pair" (first occurrence) insert -- 80 and 81. The --.
Line 63, "8" should read -- 81 --.

Column 8,
Line 6, "Corresponding" should read -- corresponding --.

Signed and Sealed this

Twelfth Day of November, 2002

*Attest:*

*Attesting Officer*

JAMES E. ROGAN
*Director of the United States Patent and Trademark Office*